US009546606B2

(12) United States Patent
Cowan et al.

(10) Patent No.: US 9,546,606 B2
(45) Date of Patent: Jan. 17, 2017

(54) ELECTRONIC THROTTLE BODY ASSEMBLY

(71) Applicant: Continental Automotive Systems, Inc., Auburn Hills, MI (US)

(72) Inventors: Nathan Cowan, Chatham (CA); Mohammed Rizwan Khan, Chatham (CA); Stefan Köhler, Frankfurt am Main (DE); John Norman Stockbridge, Waterford, Township., MI (US); Donald Taylor, Chatham (CA)

(73) Assignee: Continental Automotive Systems, Inc., Auburn Hills, MI (US)

( * ) Notice: Subject to any disclaimer, the term of this patent is extended or adjusted under 35 U.S.C. 154(b) by 107 days.

(21) Appl. No.: 14/708,364

(22) Filed: May 11, 2015

(65) Prior Publication Data

US 2015/0337743 A1 Nov. 26, 2015

Related U.S. Application Data

(60) Provisional application No. 62/001,348, filed on May 21, 2014, provisional application No. 62/029,822,
(Continued)

(51) Int. Cl.
*F02D 9/08* (2006.01)
*B01F 3/04* (2006.01)
(Continued)

(52) U.S. Cl.
CPC . *F02D 9/08* (2013.01); *B01F 3/04* (2013.01); *F02D 9/10* (2013.01); *F02D 9/105* (2013.01);
(Continued)

(58) Field of Classification Search
CPC ..... F02D 9/08; F02D 9/10; B01F 3/04
(Continued)

(56) References Cited

U.S. PATENT DOCUMENTS 6,095,488 A 8/2000 Semeyn, Jr. et al.
6,543,417 B2 * 4/2003 Tanaka ..... F02D 11/10 123/361

(Continued)

FOREIGN PATENT DOCUMENTS

EP 2075441 A1 7/2009
EP 2497921 A1 9/2012
JP 2013185489 A 9/2013

OTHER PUBLICATIONS

Omnicoil: "Square Wire Spring Manufacturing", Aug. 30, 2012, XP055208070.

(Continued)

*Primary Examiner* — Robert A Hopkins

(57) ABSTRACT

A throttle body assembly includes a housing defining a throttle bore with a throttle plate in the bore and mounted on a shaft. An electric motor has a pinion gear. A gear assembly includes an intermediate gear and a sector gear and transfers rotational drive from the electric motor to the throttle plate. Biasing structure biases the sector gear and thus the shaft to cause the throttle plate to close the throttle bore defining a closed position thereof. When the motor is energized, rotation of the pinion gear causes rotation of the gear assembly, against the bias on the sector gear, thereby causing rotation of the shaft to move the throttle plate from the closed position to an open position. A position sensor assembly determines a position of the plate.

18 Claims, 17 Drawing Sheets

Related U.S. Application Data filed on Jul. 28, 2014, provisional application No. 62/119,394, filed on Feb. 23, 2015.

(51) Int. Cl.

| | |
|---|---|
| ***F02D 9/10*** | (2006.01) |
| ***F02D 11/10*** | (2006.01) |
| *F02D 9/02* | (2006.01) |

(52) U.S. Cl.

CPC ..... *F02D 9/1065* (2013.01); *F02D 11/10* (2013.01); *F02D 11/106* (2013.01); *F02D 2009/0269* (2013.01); *F02D 2009/0284* (2013.01); *F02D 2011/102* (2013.01)

(58) Field of Classification Search

USPC ..... 123/399

See application file for complete search history.

(56) References Cited

U.S. PATENT DOCUMENTS

| | | | | |
|---|---|---|---|---|
| 6,918,374 | B1 | 7/2005 | Kurita et al. | |
| 8,448,627 | B2 * | 5/2013 | Kondo | F02D 9/1065 123/361 |
| 2008/0236541 | A1 | 10/2008 | Tsukiji et al. | |
| 2013/0160735 | A1 | 6/2013 | Cowan et al. | |
| 2013/0160738 | A1 | 6/2013 | Cowan | |
| 2013/0284147 | A1 | 10/2013 | Nicholas | |
| 2014/0144407 | A1 | 5/2014 | Khan et al. | |

OTHER PUBLICATIONS

"Powertrain Products" Sep. 30, 2013, XP055208106. pp. 61-64 and 99.

International Search Report for PCT/US2015/031585 mailed on Aug. 27, 2015.

* cited by examiner

ELECTRONIC THROTTLE BODY ASSEMBLY

FIELD

The invention relates generally to an electronic throttle body assembly for controlling air flow into the engine of a vehicle.

BACKGROUND

Throttle body assemblies are generally known, and are used for controlling the amount of air flow into the engine during vehicle operation. Due to the advancement of technology implemented in modern vehicles, and the increased number of options and features available, there have also been greater restrictions placed on the packaging configuration of throttle body assemblies, as well as greater limitations on the location and placement of the throttle body assembly. Requirements are also such that throttle body assemblies be adaptable for gasoline and diesel applications.

Furthermore, with the different orientations of an engine possible within an engine compartment, there is also the requirement for throttle body assemblies to have right-hand and left-hand configurations.

Accordingly, there exists a need for a throttle body or valve assembly which accommodates of the above mentioned requirements.

SUMMARY

The present invention is a throttle body assembly which accommodates various packaging configurations, and is adaptable for both gasoline and diesel applications.

In accordance with an embodiment, a throttle body assembly for controlling aspiration to an engine includes a housing defining a throttle bore. A throttle plate is disposed in the bore and is mounted on a shaft. An electric motor has a pinion gear. A gear assembly includes an intermediate gear and a sector gear and is constructed and arranged to transfer rotational drive from the electric motor to the throttle plate. The intermediate gear is mounted for rotation and has a first gear engaging the pinion gear so that rotation of the pinion gear rotates the intermediate gear. The intermediate has a second gear. The sector gear is coupled to the shaft and has a sector of teeth, with the second gear engaging teeth of the sector gear. Biasing structure is constructed and arranged to bias the sector gear and thus the shaft to cause the throttle plate to close the throttle bore defining a closed position thereof. A throttle position sensor assembly comprises a sensor element associated with the shaft and an inductive rotary position sensor placed in inductive relationship with the sensor element. The throttle position sensor assembly is constructed and arranged to monitor a position of the sensor element and thus the throttle plate. When the motor is energized, rotation of the pinion gear causes rotation of the first gear, with the second gear causing rotation of the sector gear, against the bias thereon, thereby causing rotation of the shaft to move the throttle plate from the closed position to an open position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
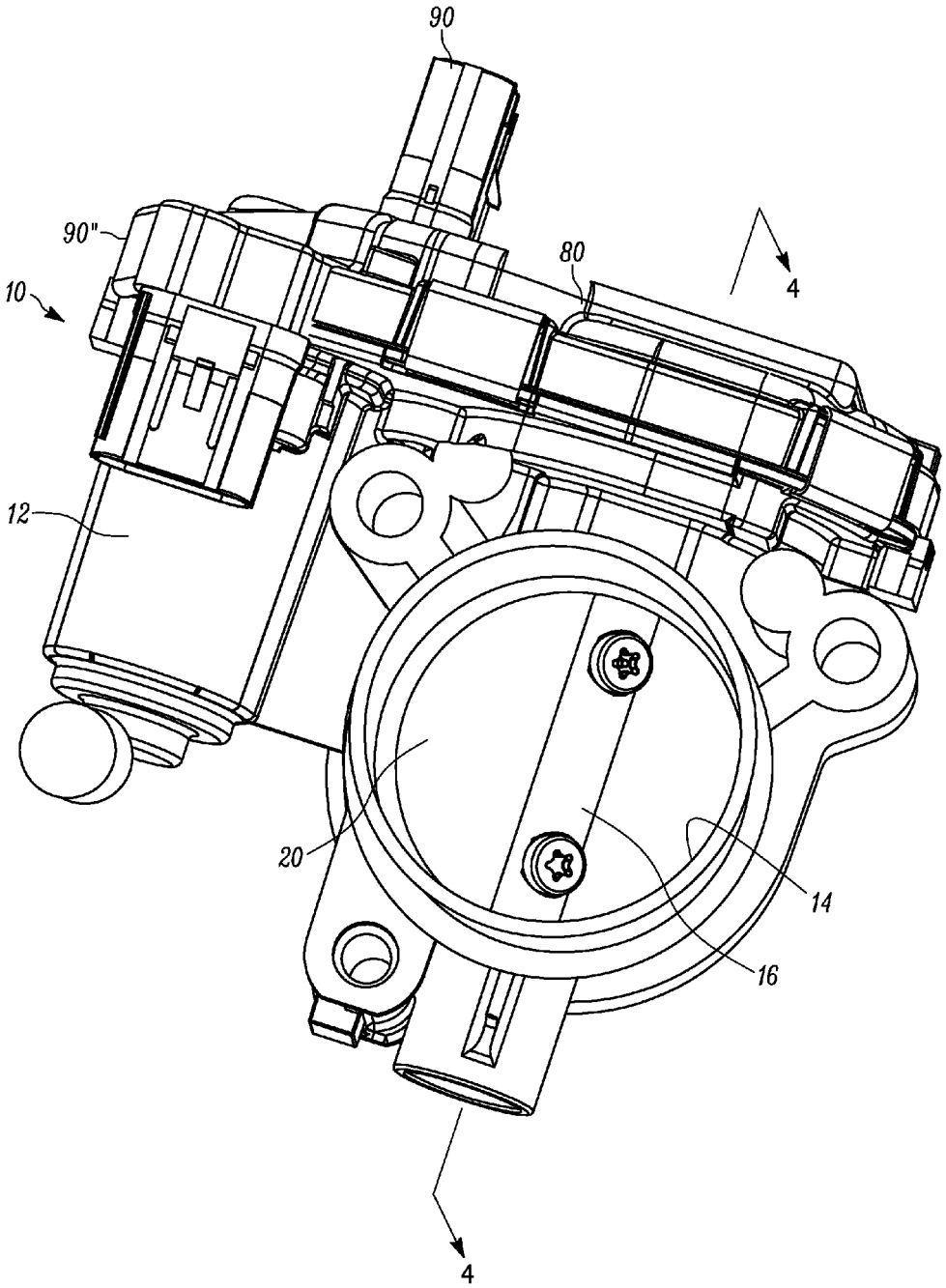
FIG. 1A is a top view of a throttle body assembly, according to an embodiment of the present invention.
Figure 6:
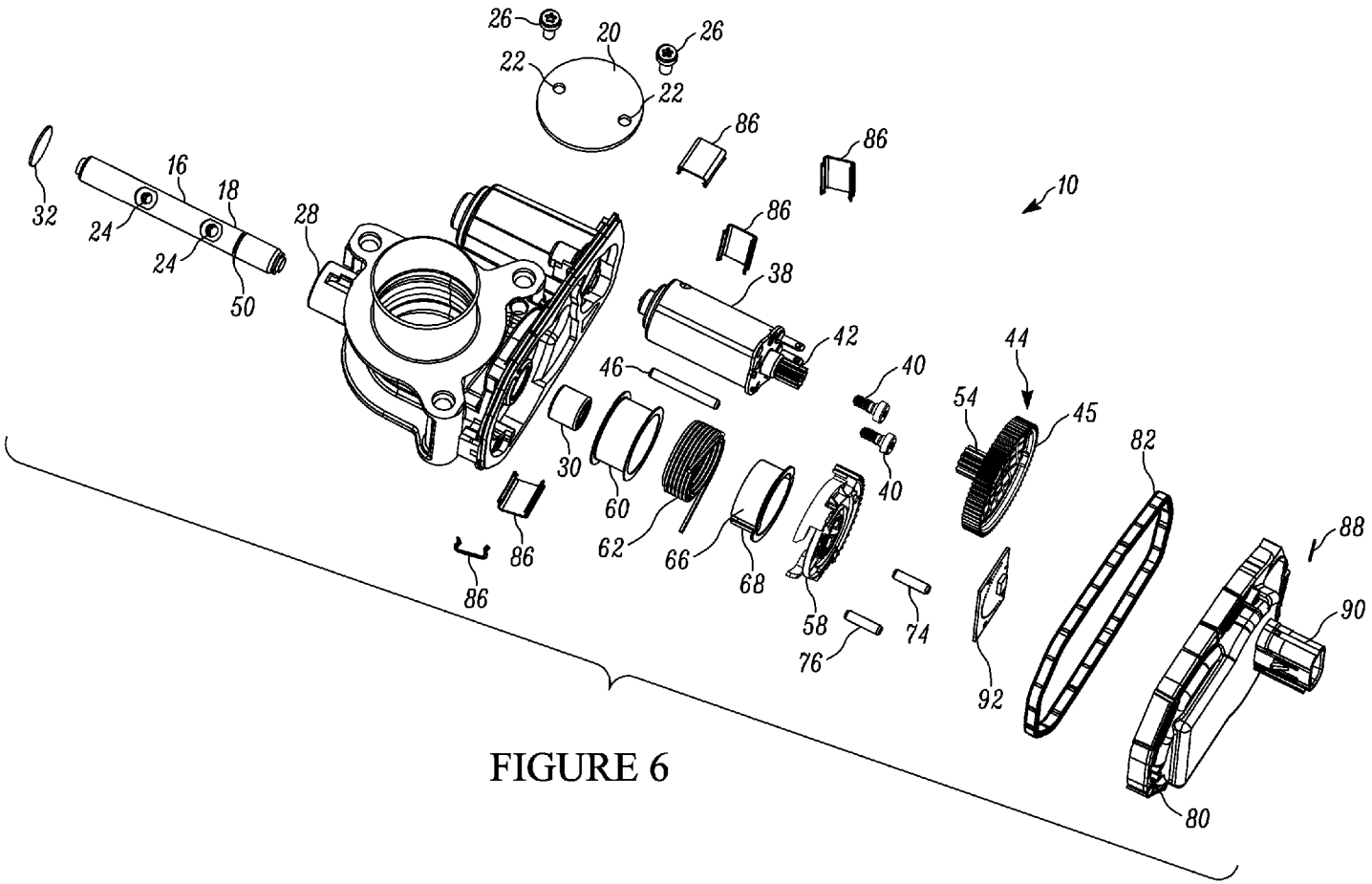
FIG. 6 is an exploded view of a throttle body assembly of an embodiment.

A throttle body assembly according to an embodiment is shown, generally indicated at 10, in FIGS. 1A and 6 for use in controlling aspiration to an engine. The assembly 10 includes a housing 12 with an integral central bore 14, through which air passes during operation of the assembly 10. A rotatable shaft 16 is disposed in the central bore 14. The shaft 16 includes a slot 18 (FIG. 4), and a valve member 20 is disposed in the slot 18. In the embodiment, the valve member 20 is in the form of an annular throttle plate. With reference to FIG. 6, the throttle plate 20 includes two apertures 22, which are in alignment with two threaded apertures 24 formed in the shaft 16. To connect the plate 20 to the shaft 16, a fastener, which in this embodiment is a threaded screw 26, is inserted through each aperture 22 of the plate 20 and into the associated threaded aperture 24 in the shaft 16.

Figure 4:
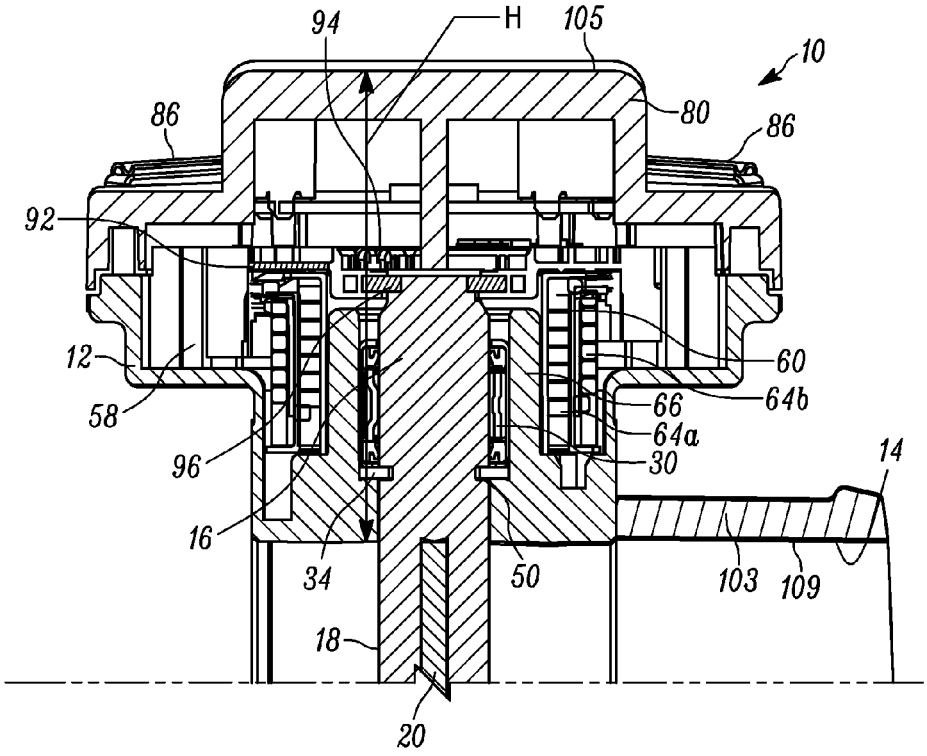
FIG. 4 is a sectional view taken along lines 4-4 of FIG. 1A.
Figure 5:
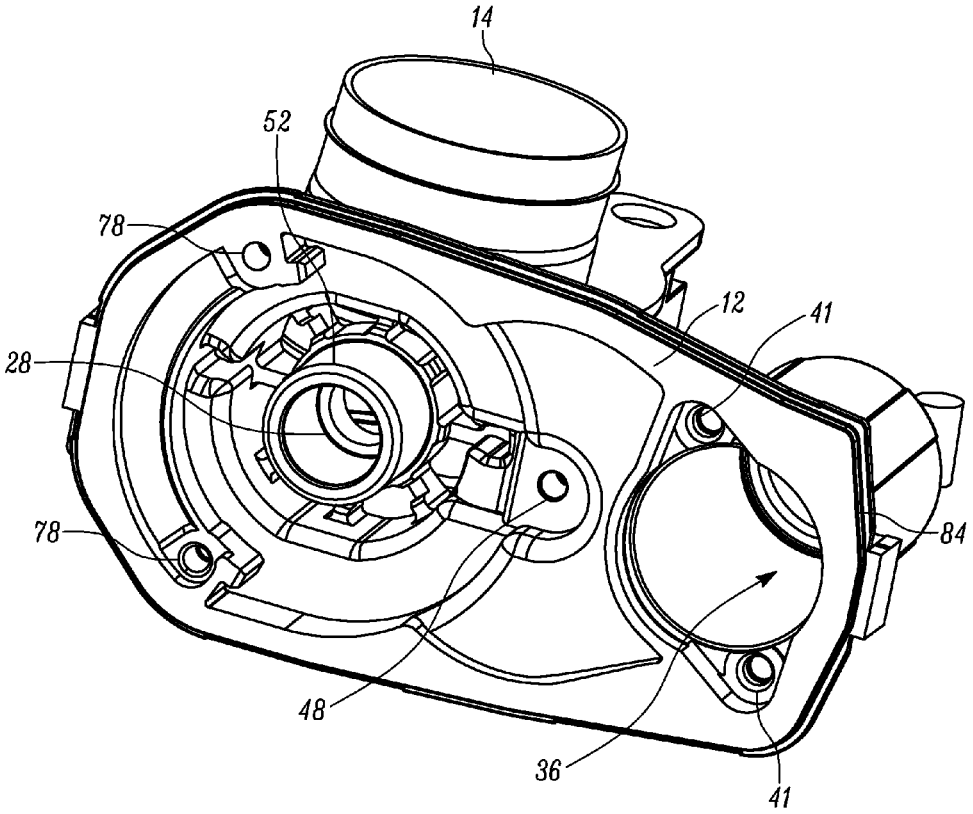
FIG. 5 is a perspective view of a housing of the throttle body assembly of FIG. 1A.

With reference to FIGS. 5 and 6, the shaft 16 is partially disposed in an aperture 28 formed in the housing 12 and disposed transverse with respect to bore 14. At least one needle bearing 30 is disposed in aperture 28 that support the shaft 16 and allow for the shaft 16 to rotate relative to the housing 12. The outer end of the aperture 28 is sealed by a plug 32. The bearing 30 is located inside and supported by a boss 52 formed in the housing 12 (FIG. 5) and retained therein by a clip 34 (FIG. 4) engaged with a groove 50 in the shaft 16.

Figure 10:
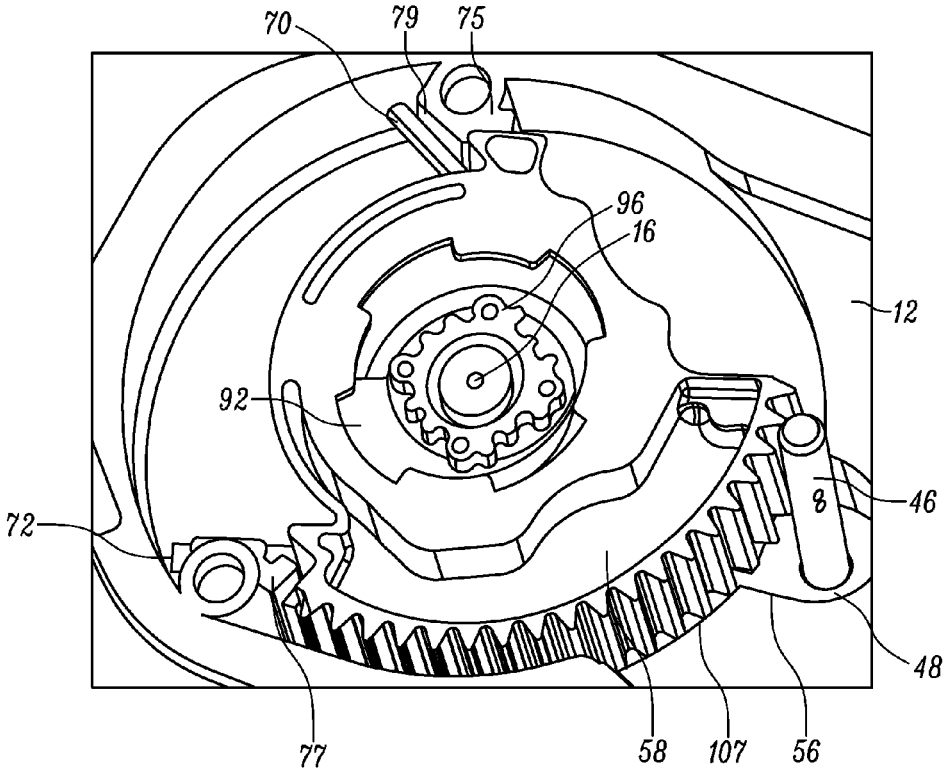
FIG. 10 is a perspective view a sector gear disposed in a housing, which is part of the throttle body assembly of FIG. 6.

The housing 12 also includes a cavity, shown generally at 36 in FIG. 5. An actuator, preferably in the form of an electric motor 38, is disposed in the cavity 36. The motor 38 is secured to the housing 12 by two motor screws 40 that are received in threaded bores 41 in the housing 12. A pinion gear 42 is attached to the rotatable shaft 43 (FIG. 8) of the motor 38. The pinion gear 42 is in meshing relation with teeth of a first gear 45 of a plastic intermediate gear, generally indicated at 44 in FIG. 6. The intermediate gear 44 is mounted on an intermediate shaft 46, and the intermediate shaft 46 partially extends into an aperture 48 formed in housing 12 (FIG. 10). A second or middle gear 54 is formed integrally and concentrically with the intermediate gear 44. The middle gear 54 has a smaller diameter than the first gear 45 and is spaced there-from. With reference to FIG. 10, when the middle gear 54 and first gear 45 are mounted on the shaft 46, the middle gear 54 is disposed for rotation in a recess 56 in housing 12 so that the teeth of the middle gear 54 are in meshing relation with teeth 107 of a preferably plastic sector gear 58 that is fixed to the shaft 16. The intermediate gear 44 and the sector gear 58 define a gear assembly of the throttle body assembly 10.

Figure 18:
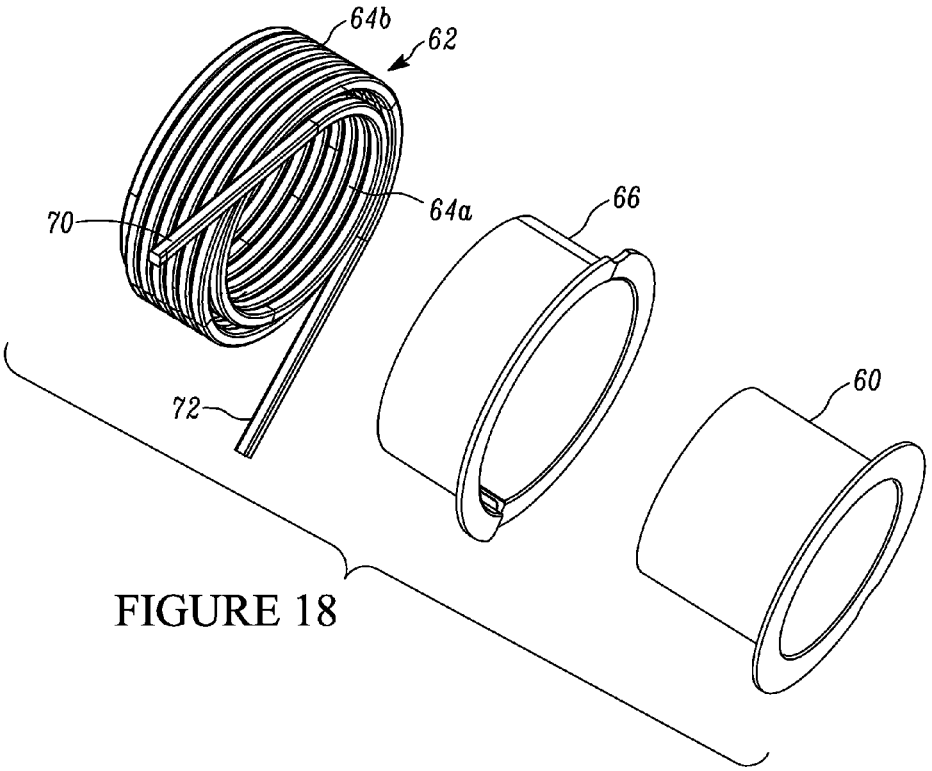
FIG. 18 is an exploded view of the lower bushing, the intermediate bushing, and the return spring of FIG. 17.
Figure 19:
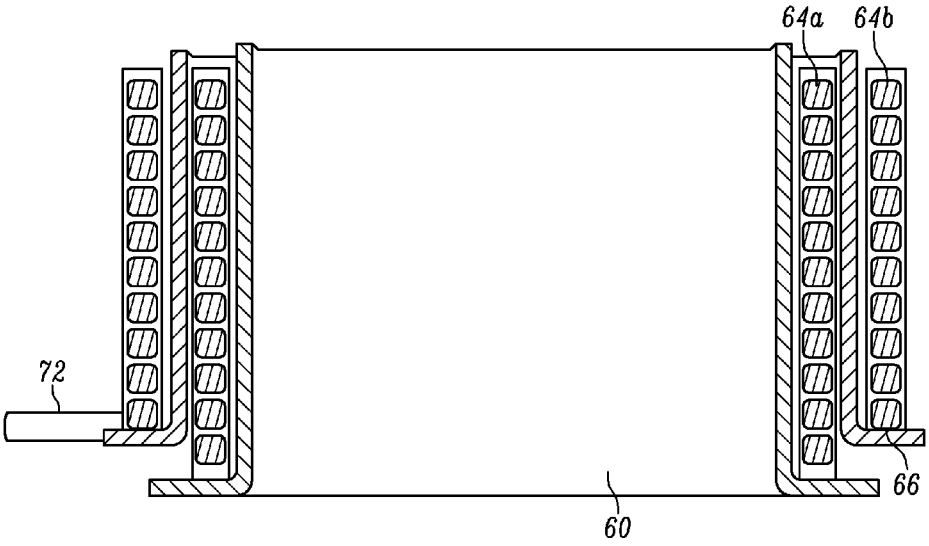
FIG. 19 is a sectional view of the lower bushing, the intermediate bushing, and the return spring of FIG. 17.

With reference to FIGS. 4 and 17-19, a lower bushing 60 is mounted on and surrounding the outside of the boss 52 (FIG. 4). Biasing structure, generally indicated at 62 in FIG. 18 is mounted on the lower bushing 60. In the embodiment, the biasing structure 62 is a return spring having a first coil portion 64*a* and a second coil portion 64*b*. More specifically, the first coil portion 64*a* surrounds the lower bushing 60. There is also an intermediate bushing 66 disposed between the first coil portion 64*a* and the second coil portion 64*b*. The intermediate bushing 66 includes a slit portion 68 (FIG. 6) which allows the intermediate bushing 66 to partially deflect without breaking, such that the coil portions 64*a*, 64*b* may be made together from a single continuous wire, and the intermediate bushing 66 may be installed between the coil portions 64*a*, 64*b*. In one embodiment, the return spring 62 has a square cross-section to increase durability, but it is within the scope of the invention that other various cross-sections may be used such as round or other shapes.

Figure 7:
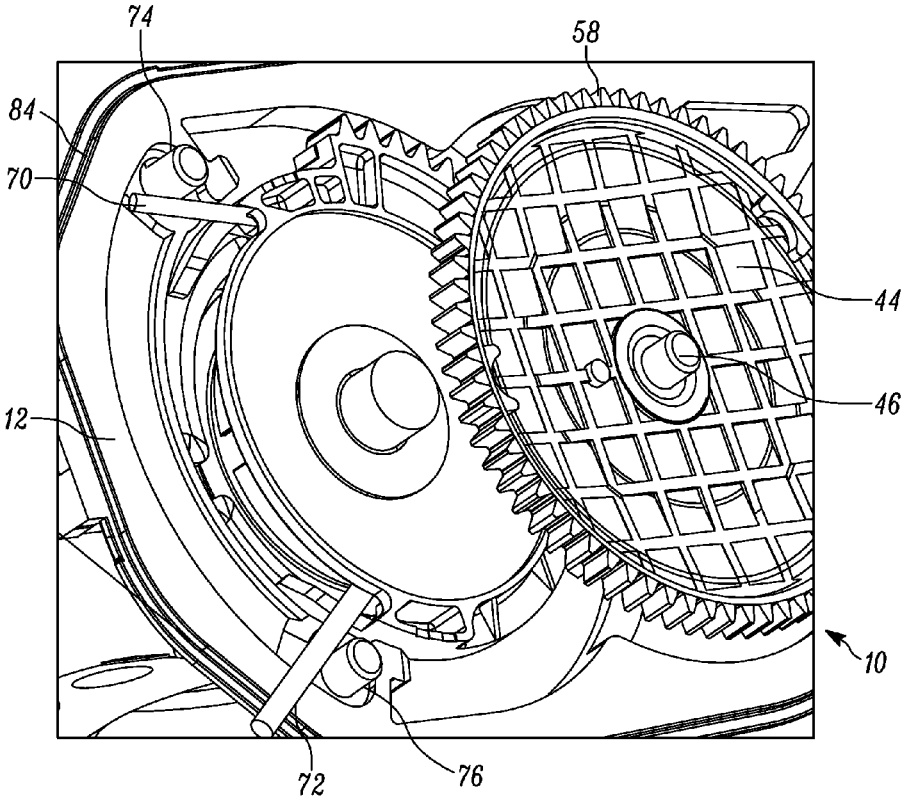
FIG. 7 is an enlarged perspective view of an intermediate gear associated with a sector gear of the throttle body assembly of FIG. 6, with the cover removed.
Figure 9:
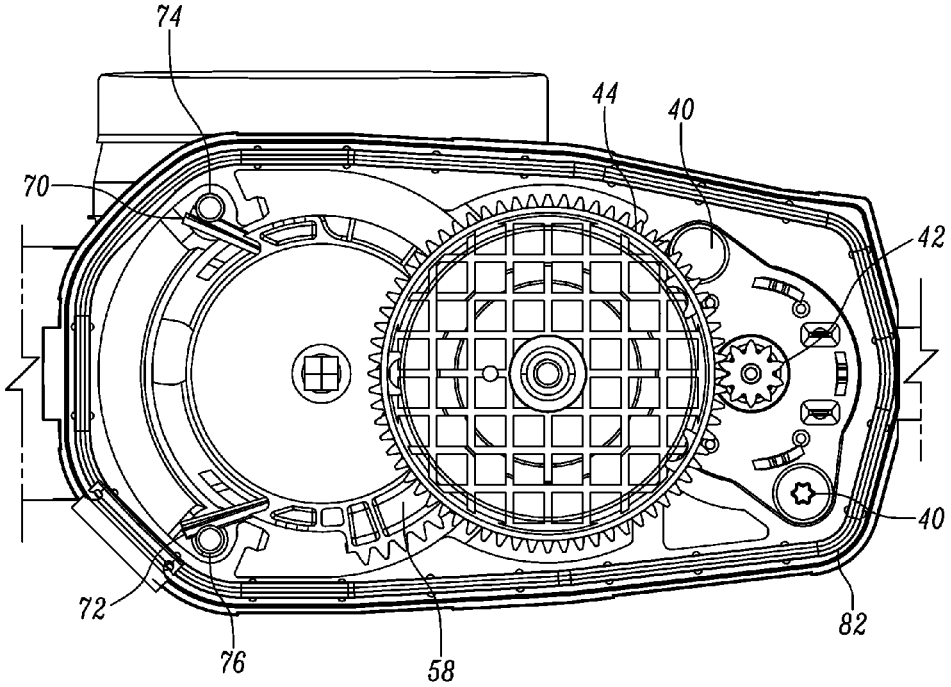
FIG. 9 is a side view of a throttle body assembly, with the cover and the sensor removed, showing stops integral with the housing that engage the return spring in accordance with another embodiment.

As shown in FIGS. 7 and 9, the sector gear 58 is mounted over the second coil portion 64*b*. A first end 70 the return spring 62 is in contact with a first pin 74 functioning as a first spring stop, and a second end 72 of the return spring 62 is in contact with a second pin 76 functioning as a second spring stop. Each of the pins 74, 76 are partially disposed in corresponding apertures 78 (FIG. 5) formed in the housing 12. The spring 62 biases the sector gear 58 and thus the shaft 16 to cause the throttle plate 20 to close the throttle bore 14. In an alternate embodiment shown in FIG. 10, stops 75 and 77 are surfaces of the housing 12 and thus are formed integral with the housing 12, replacing the pins 74, 76 of FIG. 9. The stops 75, 77 and sector gear 58 contain and cradle the spring ends 70, 72 so they don't wander and maintain their position over lifetime of the throttle body 10. Alternatively, movable clips (not shown) can be coupled to the housing 12 or sector gear 58 and used to define the stops and to adjust the default angle (closed position of the throttle plate 20), and spring hysteresis. Furthermore, calibrated shims 79 (FIG. 10) of different thicknesses can be employed between one or both of the mechanical stop 75, 77 and associated spring ends 70, 72 to adjust the default position.

Figure 22:
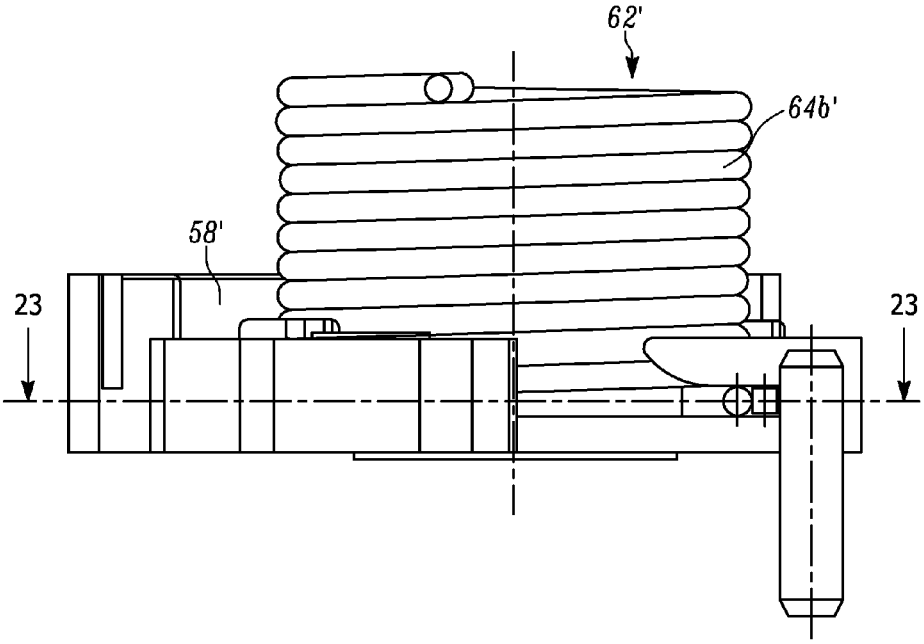
FIG. 22 is a side view of an alternate embodiment of a return spring and a sector gear a throttle body assembly.
Figure 23:
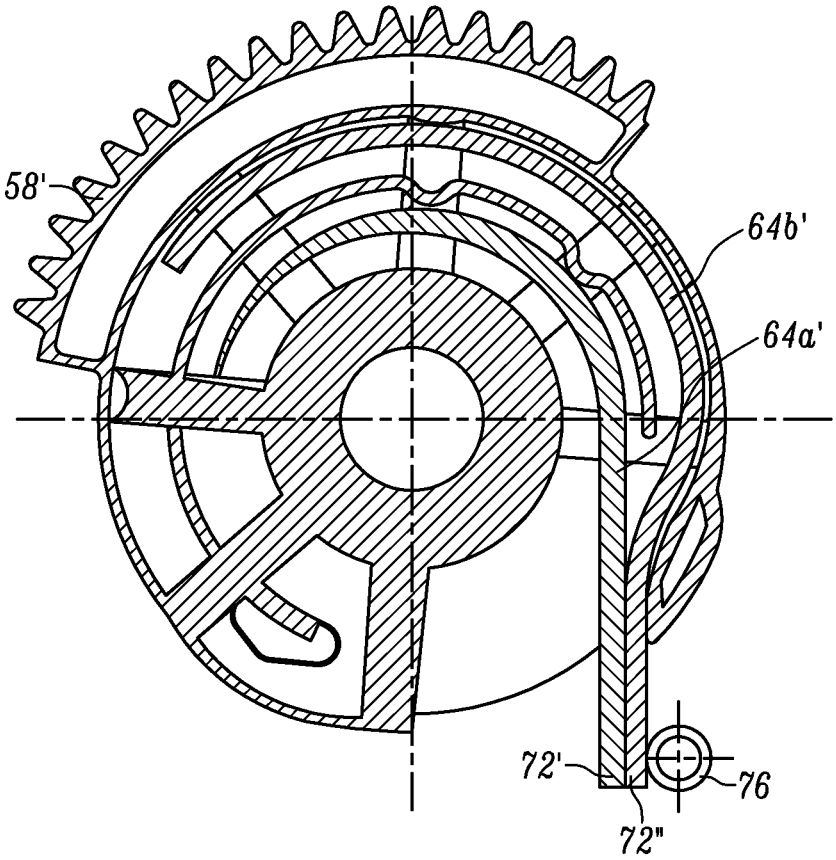
FIG. 23 is a sectional view taken along the line 23-23 in FIG. 22.

FIGS. 22 and 23 show another embodiment of the return spring 62' where the first coil portion 64*a'* is separate from the second coil portion 64*b'*. End 72" of the second coil portion 64*b'* engages the pin 76 and an end 72' of the first coil portion 64*a'* engages end 72". By this structure, both spring portions 64*a'*, 64*b'* are driven at the same time through the same angle, with the result being no angle hysteresis at the default point.

Figure 12:
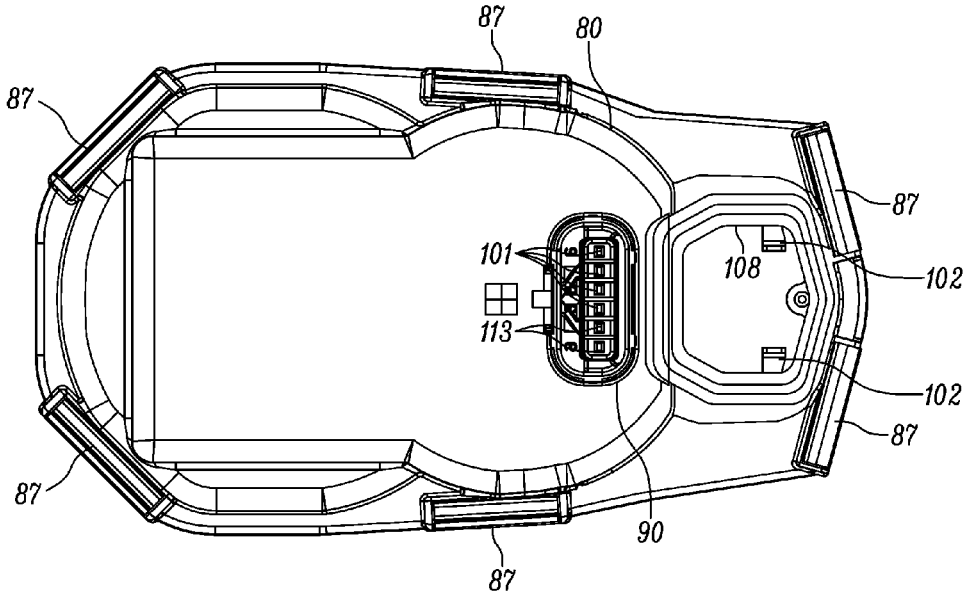
FIG. 12 is a side view of a first embodiment of the gear box cover of the throttle body assembly of FIG. 6, shown covering the leads of FIG. 11.

With reference to FIGS. 4, 6 and 12, a cover 80 is connected to the housing 12. A seal 82, preferably of silicone, is disposed between the cover 80 and the housing 12 in a groove 84 (FIG. 9) defined in the housing 12. The cover 80 is connected to the housing 12 using a plurality of clips 86. In FIG. 9, the clips are shown coupled to the housing 12 with the cover 80 removed. With reference to FIG. 12, once the cover 80 is placed on the housing 12, the clips 86 engage clip receiving surfaces 87 on the cover 80 and clamp the cover 80 to the housing 12. The clips 86 are located to avoid the height points for packaging. The clips 86 sit inside the packaging envelope in an otherwise unused area. There is also a secondary cover 88, which is attached to the cover 80. Once the cover 80 is attached to the housing 12 the terminals for the motor 38 can be accessed or viewed through an opening 108 in the cover 80. Once it is determined that the terminals of the motor 38 are in contact with the terminals formed as part of the cover 80, the secondary cover 88 is attached to the cover 80 to close the opening 108.

The cover 80 also includes a connector 90 which is in electrical communication with the motor 38, such that the connector 90 is able to be connected to a source of power. Integrally formed with the cover 80 is a lead frame defining motor leads, shown generally at 98, which places the connector 90 in electrical communication with a sensor 94, the function of which will be explained below.

Figure 11:
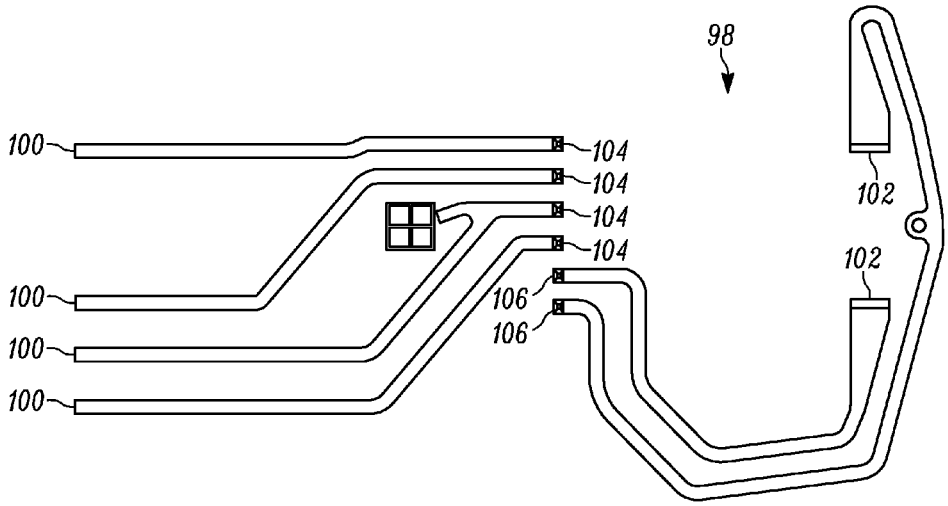
FIG. 11 is a side view of a first embodiment of motor leads for a lead frame used as part of the throttle body assembly of FIG. 6.

Referring now to FIGS. 11-16, the cover 80 and the motor leads 98 have multiple possible configurations such that an appropriate location of the electrical connector 90 on the cover can be selected based on the application of the throttle body assembly 10. A first embodiment of the leads 98 and cover 80 is shown in FIGS. 11-12, where the leads 98 includes a first set of terminals 100 which are in electrical communication with a printed circuit board (PCB) 94, and a second set of terminals 102 which are connected to and in electrical communication with the electric motor 38. The leads 98 also include a third set of terminals 104 which are in electrical communication with the first set of terminals 100, and are in electrical contact with the terminals 101 of the connector 90. Additionally, there is a fourth set of terminals 106, which are in electrical communication with the second set of terminals 102, and are in electrical contact with the terminals 103 of the connector 90. Thus, as shown in FIGS. 11 and 12, the leads 98 and cover 80 have an in-line configuration, where the connector 90 is adjacent to the opening 108 formed in the cover 80 for access to the motor terminals 102. For reverse motor direction, the polarity of the terminals 102 can be reversed.

Figure 2:
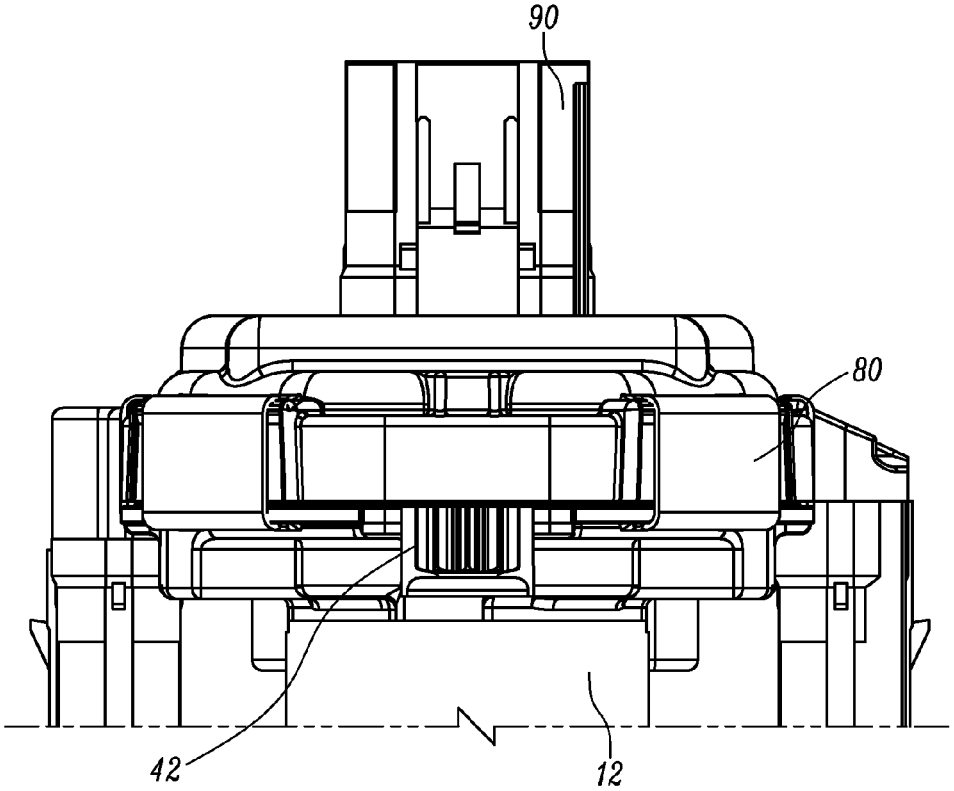
FIG. 2 is a side view of a gear box cover being placed over welded terminals of the a throttle body assembly of FIG. 1A.
Figure 3:
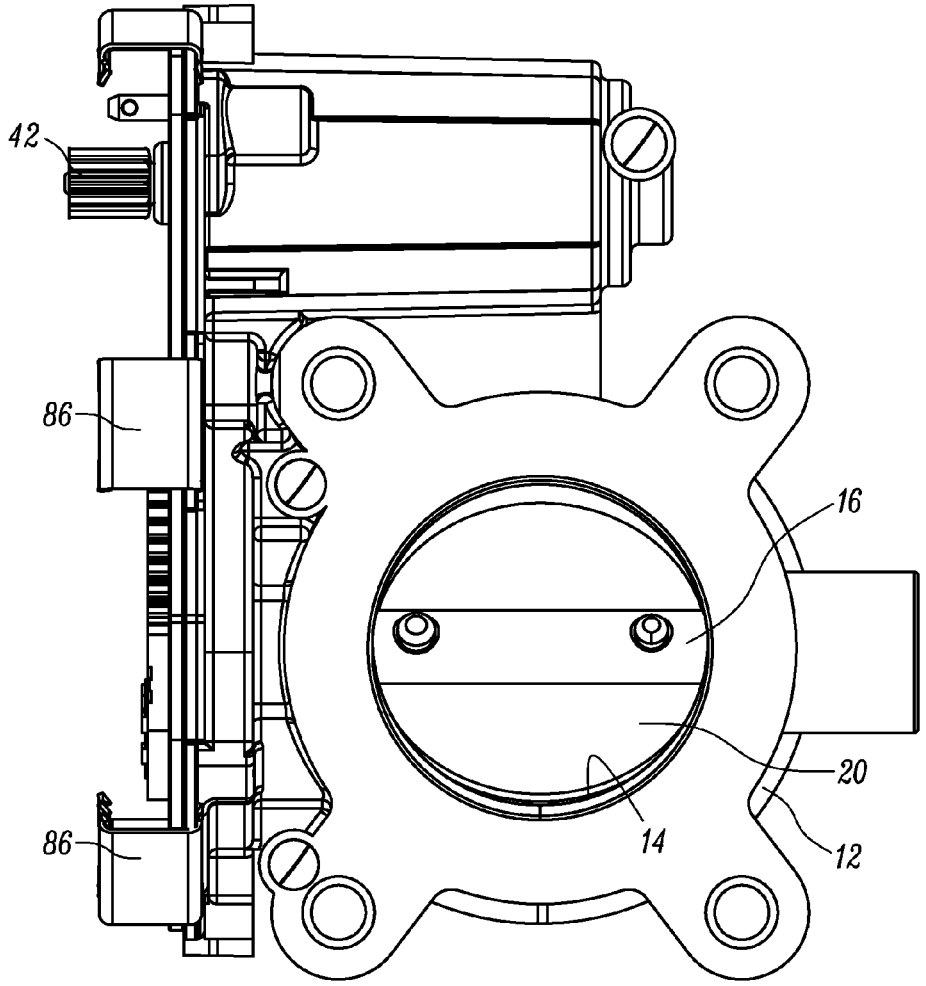
FIG. 3 is a bottom view of a throttle body assembly with the cover removed, according to another embodiment.

With reference to FIG. 2, during manufacturing, the cover 80 is assembled part way, and terminals 101, 103 are welded and then the cover 80 is then assembled to its final position. Thus, the terminals can be welded without requiring another cover/opening in the cover 80. Various welding methods can be used, such as laser welding.

Figure 13:
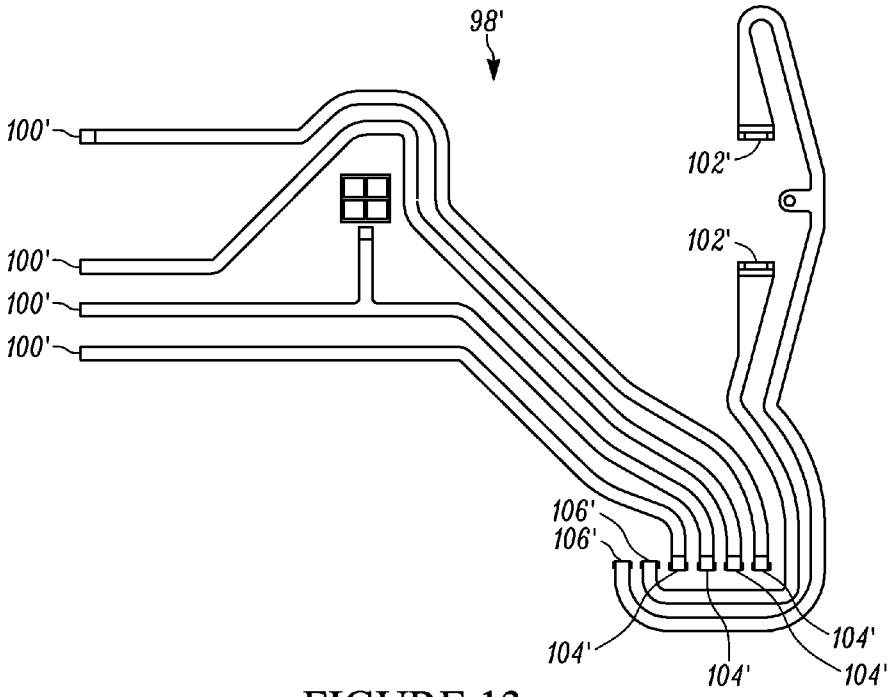
FIG. 13 is a side view of a second embodiment of motor leads for a lead frame used as part of a throttle body assembly.
Figure 14:
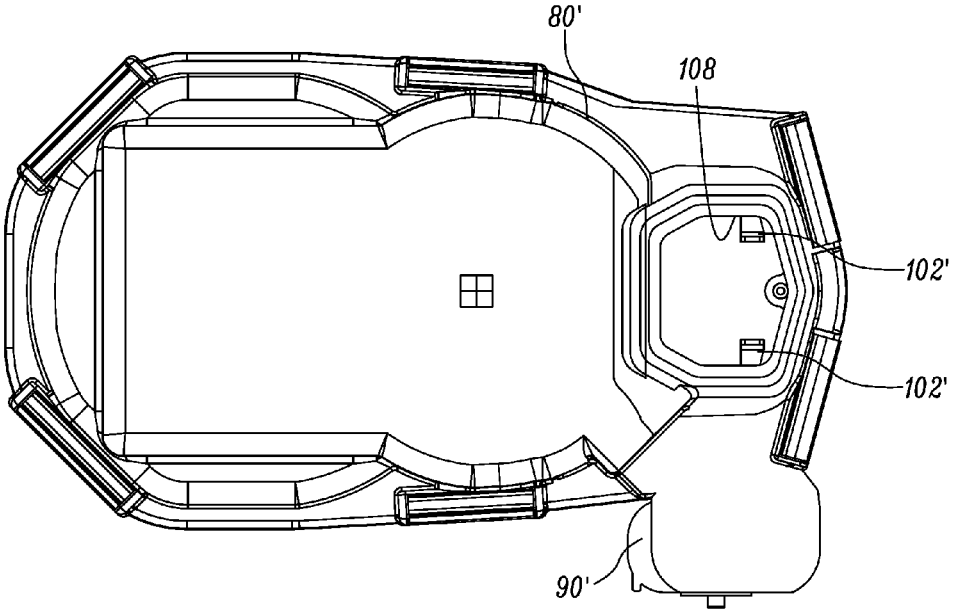
FIG. 14 is a side view of a second embodiment of a gear box cover of a throttle body assembly, shown covering the leads of FIG. 13.

Another embodiment of the leads 98' and cover 80' is shown in FIGS. 13-14, with like numbers referring to like elements. In this embodiment, the leads 98' and cover 80' have a left-hand wrap style configuration, where the terminals 104', 106' are configured such that the connector 90' is located below the opening 108, as shown in FIG. 14 and accessible from a direction opposite that of the connector 90 in FIG. 12. For reverse motor direction, the polarity of the terminals 102' can be reversed.

Figure 15:
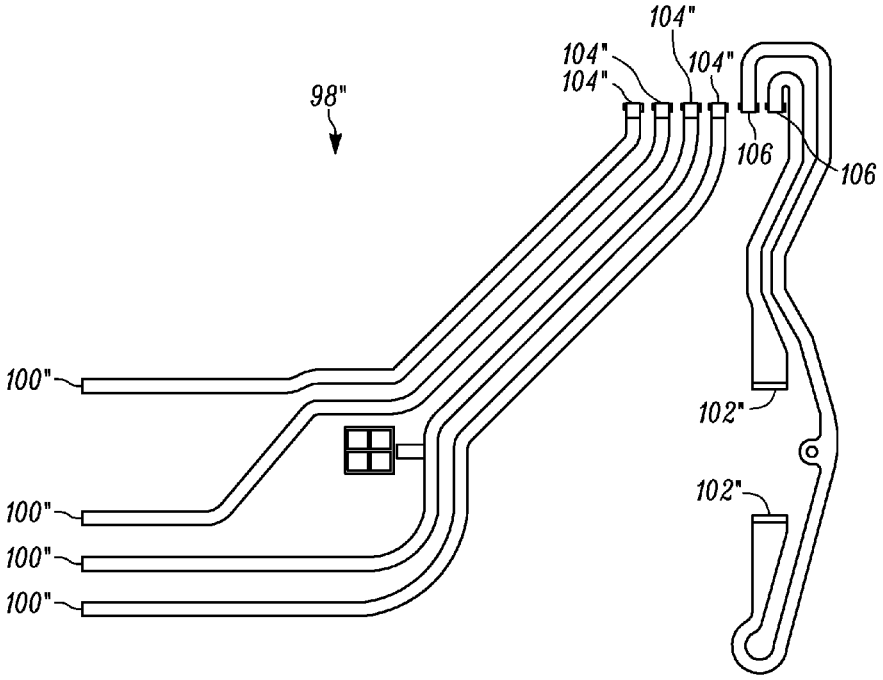
FIG. 15 is a side view of a third embodiment of motor leads for a lead frame used as part of a throttle body assembly.
Figure 16:
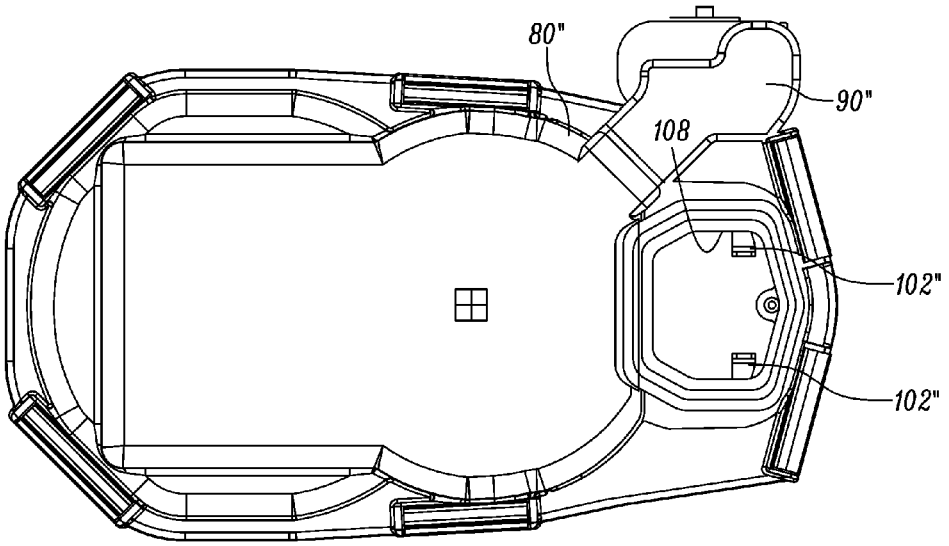
FIG. 16 is a side view of a third embodiment of a gear box cover of a throttle body assembly, shown covering the leads of FIG. 15.
Figure 17:
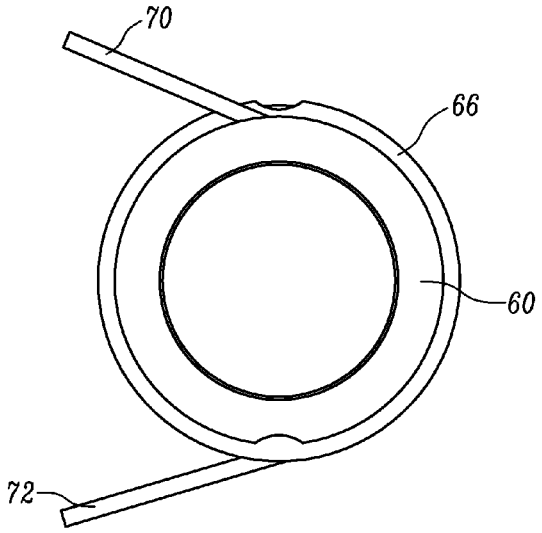
FIG. 17 is a side view of a lower bushing, an intermediate bushing, and return spring which are used as part of the throttle body assembly of FIG. 6.

Another embodiment of the leads 98" and cover 80" are shown in FIGS. 15-16. In this embodiment, the leads 98" and cover 80" have a right-hand wrap style configuration, where the terminals 104", 106" are configured such that the connector 90" is located above the opening 108 and accessible from a direction opposite that of the connector 90 in FIG. 12. For reverse motor direction, the polarity of the terminals 102" can be reversed.

In each of the embodiments shown in FIGS. 11-16, the first set of terminals 100, 100', 100" and the second set of terminals 102, 102', 102" are in the same location relative to the associated cover 80, 80' 80", such that the motor 38 and the PCB sensor 94 have the same configuration in each embodiment, while still having the variation in the location of the other terminals 104 104', 104", and 106, 106' 106" to allow for different configurations of the connector 90.

Figure 1B:
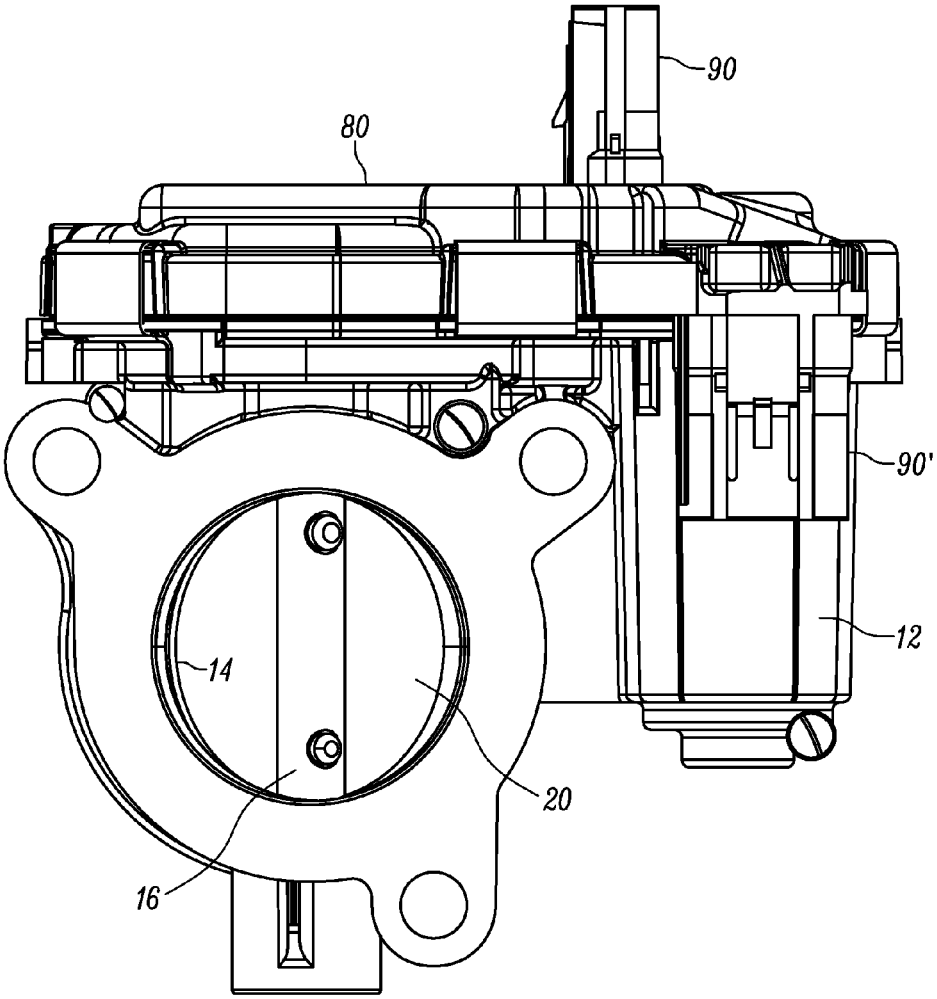
FIG. 1B is a bottom view of a throttle body assembly of FIG. 1A.

FIGS. 1A and 1B show another embodiment of the cover 80 where a single cover includes all three connectors 90, 90' and 90". Thus, depending on the orientation required, the terminals are provided in the appropriate connector and the leads are configured based on the selected connector location. This ensures a common seal profile, a common cover 80 and common sealing area on the housing 12, which reduces number of components required and thus saves cost. Also, the same cover 80 can be used for different types of sensors 94.

The throttle body assembly 10 comprises an inductive rotary position sensor assembly that includes a sensor element 92 that is disposed with respect to the inductive rotary position sensor 94 so as to be in an electrically inductive relationship therewith. In this configuration, the position sensor 94 detects movement and position of the sensor element 92, which is compared to reference data to determine the position of the throttle plate 20.

Referring to FIGS. 4 and 10, the sensor element 92, preferably of aluminum, is attached to the sector gear 58 preferably by over-molding or by any suitable means. Alternatively, the sensor element 92 can be placed, rotated and locked into position with preferably heatstakes. Any other type of sensing element 92 associated with the shaft 16 for rotation therewith can be provided. Locking the sensor element 92 in place can be done without heatstakes, by using, for example, adhesive, potting, screws, or other methods. The sector gear 58 includes an insert 96 that is welded or otherwise coupled to the end of the shaft 16. Thus, as the throttle plate 14 is moved between an open position and closed position, the sensor element 92 moves with the sector gear 58. Accordingly, movement and position of the sensor element 92 is directly related to movement and position of the throttle plate 20.

Figure 8:
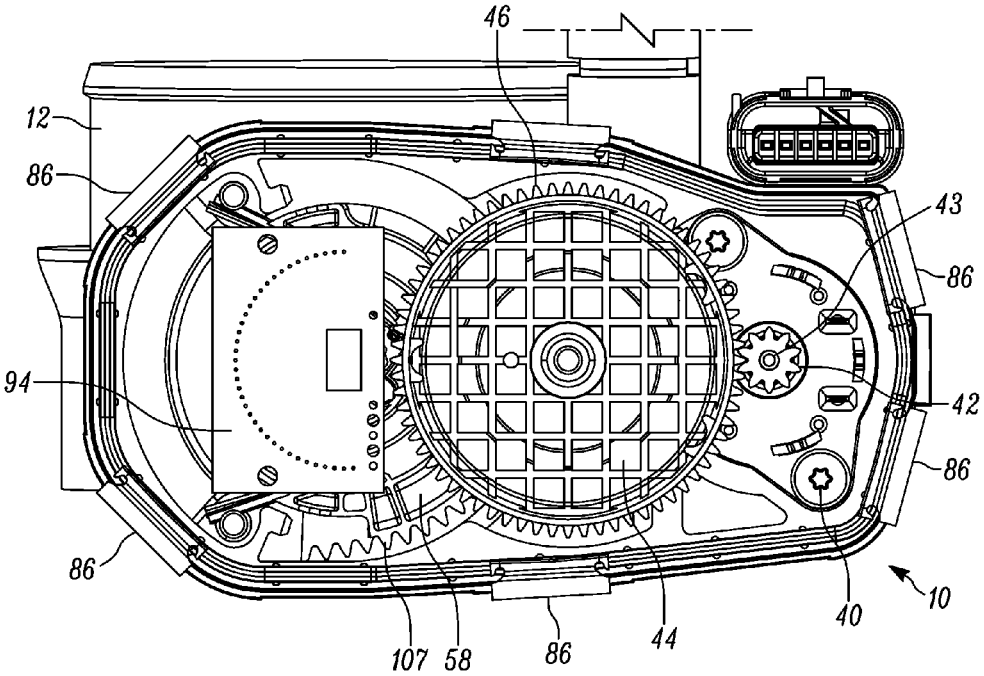
FIG. 8 is a side view of the throttle body assembly of FIG. 1A, with the cover removed, showing the return spring and cooperating stop pins.

Referring to FIGS. 8 and 10, the position sensor 94 is disposed in an inductive relationship to the sensor element 92. In the configuration shown, the position sensor 94 is mounted to inside of the cover 80 of the throttle body assembly 10 using suitable attachment means. The position sensor 94 comprises a PCB sensor board so that as the sensor element 92 moves, different inductive readings are observed across the sensor board 94, which are transferred a sensor processor, which transmits signals to a monitor or control unit of the throttle body assembly 10, or engine, through connector 90.

As shown in FIG. 4, an air gap is provided between the position sensor 94 or sensor board and the inside of the cover 80 preferably greater than 0.5 mm. This creates a thermal separation between the position sensor 94 and the cover 80 and helps to reduce condensation. This may be done in conjunction with or separately from cutouts in the sensor board 94 that provide open space between adjacent terminals and a barrier against any surface tracking of moisture or other contaminants.

In operation, the spring 62 biases the sector gear 58, and therefore the shaft 16 and throttle plate 20 towards a closed position, such that the central bore 14 is substantially closed, or blocked completely, depending upon how the assembly 10 is configured. When current is applied to the motor 38, the pinion gear 42 is rotated, which causes the rotation of the first gear 45 of the intermediate gear 44, the second or middle gear 54 of the intermediate gear 44, and the sector gear 58. To rotate the sector gear 58, the bias applied to the sector gear 58 by the return spring 62 is overcome. The amount of rotation of the sector gear 58 is in proportion to the amount of current applied to the motor 38, which must overcome the force applied to the sector gear 58 by the return spring 62. Since the sector gear 58 is coupled to the shaft 16 by the insert 96, rotation of the sector gear 58 rotates the shaft 16 to open the plate 20. As noted above, the sensor element 92 and the position sensor 94 detect the position of the sector gear 58 and thus the plate 20 during the operation of the throttle body assembly 10.

As the sector gear 58 is rotated, the shaft 16 is rotated as well, rotating the plate 20, and allowing increased levels of air flow through the central bore 14. The amount of rotation of the sector gear 58 is detected by the sensor 94, such that the valve plate 20 may be placed in a desired position.

With reference to FIG. 4, with the embodiment, the gearbox vertical height H (cover 80 and housing 12) from surface 109 of the bore 14 to the top 105 of the cover 80 is about 40 mm instead of the conventional height of about 50 mm. This enhances packaging on the vehicle.

Figure 20:
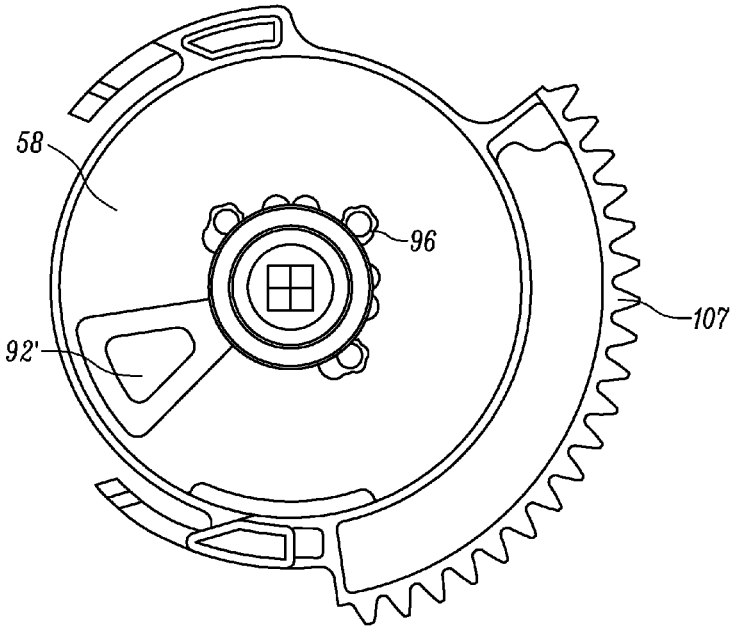
FIG. 20 is a side view of an alternate embodiment of a sector gear used as part of a throttle body assembly.
Figure 21:
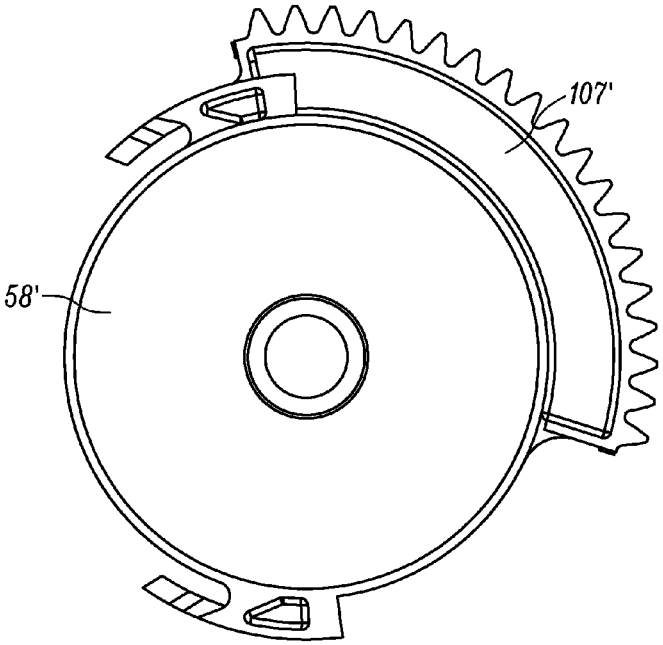
FIG. 21 is a side view of an alternate embodiment of a sector gear used in diesel applications.

With reference to FIGS. 20 and 21, orientation and configuration of the sector gear 58 is chosen for the application. For example, as shown in FIG. 20, for gasoline applications, the gear teeth 107 of sector gear 58 can be oriented at a 30 degree position and as shown in FIG. 21, for diesel applications, the sector gear teeth 107' of the sector gear 58' can be oriented at a 93 degree position. As shown, the sector gears 58, 58' have teeth 107, 107' only on an arc-shaped sector thereof (less than 360°). Thus, sector gear 58 is constructed and arranged to be interchangeable with another sector gear 58' so that the throttle body assembly 10 can be employed for a diesel fuel application or a gasoline fuel application without further modification of the throttle body assembly 10.

The embodiment employs a common sector gear 58 for three different geartrain ratios and provides a common center distances for the three different sets of gears. In addition, the sector gear 58 is the same for left-hand and right-hand applications, so that the same molding tool, same insert 96 can be used for the two different positions (LH/RH). The spring arm positions remain same for both diesel and gasoline applications and only the teeth positions change with respect to the spring arms.

With the embodiment, different motor performance is available with the same or different geartrains. The throttle body assembly 10 can be tuned to the application by swapping only the motor 38 and the intermediate gear 44.

An alternate embodiment of the sector gear 58 is shown in FIG. 20, where the sector gear 58 includes a sensor element or rotor 92' that is made integral with the steel or metal insert 96 to reduce the number of parts. Alternatively, the sensor rotor 92' can be applied to the sector gear 58 using an adhesive aluminum film, or a strip that is attached to the sector gear 58 with an adhesive. In other alternate embodiments, the sensor rotor 92' is a metalized plastic, or a painted on or conductive coating located in a pattern on the sector gear 58, where the coating is electrically conductive.

With the compact configuration of the throttle body assembly 10, the height of from the manifold mounting flange to a bottom surface of the inlet duct is about 33 mm and can be as low as about 20 mm. This height in conventional throttle bodies is 40 mm or larger. This reduce height is advantageous for packaging on the vehicle and other applications and reduces the mass of the throttle body assembly 10.

A window (not shown) can be added in the plastic cover 80 around each solder joint to enable visual inspection of the joint quality without damaging/disassembling the component.

Although the throttle body assembly 10 is typically used for controlling air flow into an engine, the assembly 10 can be used to control coolant, water or other fluids in various applications that require a valve assembly.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A valve assembly comprising:

a housing defining a throttle bore, a throttle plate disposed in the bore and mounted on a shaft, an electric motor having a pinion gear, a gear assembly comprising an intermediate gear and a sector gear, the gear assembly being constructed and arranged to transfer rotational drive from the electric motor to the throttle plate, the intermediate gear being mounted for rotation and having a first gear engaging the pinion gear so that rotation of the pinion gear rotates the intermediate gear, the intermediate having a second gear, the sector gear being coupled to the shaft and having a sector of teeth, the second gear engaging teeth of the sector gear, biasing structure constructed and arranged to bias the sector gear and thus the shaft to cause the throttle plate to close the throttle bore defining a closed position thereof, and a throttle position sensor assembly comprising a sensor element associated with the shaft and an inductive rotary position sensor placed in inductive relationship with the sensor element, the throttle position sensor assembly being constructed and arranged to monitor a position of the sensor element and thus the throttle plate, wherein, when the motor is energized, rotation of the pinion gear causes rotation of the first gear, with the second gear causing rotation of the sector gear, against the bias thereon, thereby causing rotation of the shaft to move the throttle plate from the closed position to an open position, wherein the biasing structure comprises at least one coil spring having first and second ends, each of the first and second ends engaging a fixed stop associated with the housing to define the closed positon of the throttle plate.

2. The assembly of claim 1, wherein each stop is a pin coupled to the housing.

3. The assembly of claim 1, wherein each stop is a surface integral with the housing.

4. The assembly of claim 1, further comprising a shim between at least one of the ends of the spring and the associated stop to adjust the closed position of the throttle plate.

5. The assembly of claim 1, wherein the coil spring comprises square wire.

6. The assembly of claim 1, further comprising a cover covering the gear assembly and sensor assembly, the cover being coupled to the housing by a plurality of clips.

7. The assembly of claim 6, further comprising a seal between the cover and the housing.

8. The assembly of claim 6, wherein the cover includes three electrical connectors each at a different location with respect to the cover, with at least one of the electrical connectors including terminals for powering the motor and for receiving signals from the throttle position sensor assembly.

9. The assembly of claim 6, wherein the housing and cover are constructed and arranged such that a height from a surface of the bore to a top of the cover is about 40 mm.

10. The assembly of claim 1, wherein the sensor element is coupled to the sector gear.

11. The assembly of claim 1, wherein the sector gear includes a metal insert that is coupled to the shaft, and wherein the sensor element is integral with the insert.

12. The assembly of claim 10, wherein the sensor element is metal or metalized plastic, or an electrically conductive coating on the sector gear.

13. The assembly of claim 6, further comprising electrical leads electrically connected with the position sensor and with the certain of the terminals.

14. The assembly of claim 6, wherein the cover further comprises:

an opening in the cover constructed and arranged to gain access to terminals which are connected to and in electrical communication with the electric motor, and a secondary cover for closing the opening.

15. The assembly of claim 1, wherein the biasing structure comprises first and second coil springs, each having first and second ends, a first end of the first coil spring being engaged with a first end of the second coil spring, with the first end of the second coil spring engaging a stop, so that both coil springs can be driven at the same time through the same angle.

16. A valve assembly comprising:

a housing defining a throttle bore, a throttle plate disposed in the bore and mounted on a shaft, an electric motor having a pinion gear, a gear assembly comprising an intermediate gear and a sector gear, the gear assembly being constructed and arranged to transfer rotational drive from the electric motor to the throttle plate, the intermediate gear being mounted for rotation and having a first gear engaging the pinion gear so that rotation of the pinion gear rotates the intermediate gear, the intermediate having a second gear, the sector gear being coupled to the shaft and having a sector of teeth, the second gear engaging teeth of the sector gear, biasing structure constructed and arranged to bias the sector gear and thus the shaft to cause the throttle plate to close the throttle bore defining a closed position thereof, and a throttle position sensor assembly comprising a sensor element associated with the shaft and an inductive rotary position sensor placed in inductive relationship with the sensor element, the throttle position sensor assembly being constructed and arranged to monitor a position of the sensor element and thus the throttle plate, wherein, when the motor is energized, rotation of the pinion gear causes rotation of the first gear, with the second gear causing rotation of the sector gear, against the bias thereon, thereby causing rotation of the shaft to move the throttle plate from the closed position to an open position, wherein the sector gear is constructed and arranged to be interchangeable with another sector gear so that the assembly can be employed for either a diesel fuel application or a gasoline fuel application without further modification of the assembly.

17. A throttle body assembly for controlling aspiration to an engine, the assembly comprising:

a housing defining a throttle bore, a throttle plate disposed in the bore and mounted on a shaft, an electric motor having a pinion gear, a gear assembly comprising an intermediate gear and a sector gear, the gear assembly being constructed and arranged to transfer rotational drive from the electric motor to the throttle plate, the intermediate gear being mounted for rotation and having a first gear engaging the pinion gear so that rotation of the pinion gear rotates the intermediate gear, the intermediate having a second gear, the sector gear being coupled to the shaft and having a sector of teeth, the second gear engaging teeth of the sector gear, biasing structure constructed and arranged to bias the sector gear and thus the shaft to cause the throttle plate to close the throttle bore defining a closed position thereof, and a cover covering the gear assembly, the cover being coupled to the housing, the housing and cover being constructed and arranged such that a height from a surface of the bore to a top of the cover is about 40 mm, wherein, when the motor is energized, rotation of the pinion gear causes rotation of the first gear, with the second gear causing rotation of the sector gear, against the bias thereon, thereby causing rotation of the shaft to move the throttle plate from the closed position to an open position.

18. The assembly of claim 17, wherein the biasing structure comprises at least one coil spring having first and second ends, each of the first and second ends engaging a stop associated with the housing to define a the closed positon of the throttle plate.

* * * * *